US005671534A

United States Patent [19]

Mayerovitch

[11] Patent Number: 5,671,534

[45] Date of Patent: Sep. 30, 1997

[54] RAZOR BLADE ASSEMBLY

[76] Inventor: M. Dave Mayerovitch, 17300 17th St., #J-368, Tustin, Calif. 92780

[21] Appl. No.: 680,149

[22] Filed: Jul. 15, 1996

[51] Int. Cl.[6] ..... B26B 21/14; B26B 21/44

[52] U.S. Cl. ..... 30/41; 30/48; 30/50

[58] Field of Search ..... 30/41, 47–50, 30/34.05, 32, 346.5

[56] References Cited

U.S. PATENT DOCUMENTS

| | | | |
|---|---|---|---|
| 237,174 | 2/1881 | Durand et al. . | |
| 338,047 | 3/1886 | Ehrlich . | |
| 358,751 | 3/1887 | Rein . | |
| 1,408,355 | 2/1922 | Jones . | |
| 1,444,764 | 2/1923 | Rohde et al. . | |
| 1,552,234 | 9/1925 | Roebuck . | |
| 1,624,707 | 4/1927 | Alland . | |
| 1,701,036 | 2/1929 | Greene . | |
| 1,848,666 | 3/1932 | Schodlbauer . | |
| 1,941,208 | 12/1933 | Hoff | 30/12 |
| 1,960,406 | 5/1934 | Blake | 30/12 |
| 2,027,213 | 1/1936 | Vonschott | 30/72 |
| 2,083,580 | 6/1937 | Schmitt | 30/77 |
| 2,198,531 | 4/1940 | Fulenwider | 30/77 |
| 2,300,794 | 11/1942 | Martin | 30/77 |
| 2,457,590 | 12/1948 | Mills | 30/69 |
| 2,607,112 | 8/1952 | Tomlinson | 30/58 |
| 2,679,095 | 5/1954 | Dovica | 30/58 |
| 2,766,521 | 10/1956 | Benvenuti | 30/34 |
| 2,769,233 | 11/1956 | Duke | 30/69 |
| 3,465,436 | 9/1969 | Musso | 30/41 X |
| 3,722,090 | 3/1973 | Dawidowicz | 30/32 |
| 4,461,079 | 7/1984 | Ciaffone et al. | 30/79 |
| 4,562,644 | 1/1986 | Hitchens | 30/77 |
| 4,850,107 | 7/1989 | Valliades et al. | 30/41 |
| 4,944,090 | 7/1990 | Sumnall | 30/41 |
| 4,984,364 | 1/1991 | Simmons | 30/41 X |
| 5,001,832 | 3/1991 | Althaus | 30/77 |
| 5,056,222 | 10/1991 | Miller et al. | 30/41 X |
| 5,134,775 | 8/1992 | Althaus et al. | 30/41 |

*Primary Examiner*—Douglas D. Watts
*Attorney, Agent, or Firm*—Stetina Brunda & Buyan

[57] ABSTRACT

A razor blade assembly comprising a body assembly having a pair of body end portions and at least one cross member extending therebetween. A first U-shaped housing is provided between the body end portions, the first U-shaped housing having a scalloped edge portion formed along at least one edge thereof; a resilient foam insert is provided, at least a portion of which is disposable within the first U-shaped housing, the insert being impregnated with a lubricating material. A second U-shaped housing is provided having a plurality of fluid dispensing apertures formed therein, the second U-shaped housing being supportable by the foam insert and translatable within a first U-shaped housing, beyond the scalloped edge portion, to discharge a lubricating fluid from the resilient foam insert through the fluid dispensing apertures. A plurality of blade supporting members disposed upon the second U-shaped housing, and a first blade is disposed between the body end portions adjacent the blade support members to cause compression of the foam insert in response to forces encountered during the shaving operation.

12 Claims, 4 Drawing Sheets

RAZOR BLADE ASSEMBLY

FIELD OF THE INVENTION

The invention relates to shaving implements and, more particularly, to a razor blade assembly adapted to dispense lubricating fluid upon the surface to be shaved, in response to forces encountered during the shaving operation.

BACKGROUND OF THE INVENTION

Consumers of razor blade assemblies desire a product that provides close, comfortable shave, and is as convenient to use as possible. Innovations in shavers have substantially improved the quality of those commercially available razor blade assemblies. For example, contemporary razor blade assemblies incorporate sharp, thin blades, supported along their length in a manner to allow the blades to flex during the shaving process. Ribs or brushes may be provided downstream of the blade to allow the blade assembly to set up whiskers before they encounter the blades. Soap bars have been provided on the blade assembly, upstream of the blades, to provide lubrication to facilitate movement of the blade assembly along the face of the user. Moreover, the assemblies may be formed in such a manner that the entire shaving head pivots to permit rotation of the entire head assembly during the shaving operation.

While these and other innovations have produced substantial improvements in the comfort and quality of shavers, they have not adequately addressed convenience factors relating to the need to apply shaving cream to the surface being shaved one or more times during the course of using the razor blade assembly. The present invention is directed to a razor blade assembly which addresses those convenience factors, without sacrificing the advantages of contemporary razor blade assemblies. The present invention is directed to an assembly wherein a lubricating fluid, such as soapy water, is dispensed from the razor blade assembly in the course of use. More particularly, the present invention makes use of the forces encountered during the shaving operation to cause a lubricating fluid, to be dispensed without any further action on the part of the user. As a result, the present invention allows shaving to proceed without the need for repeated applications of shaving cream in the course of the process.

SUMMARY OF THE INVENTION

A razor blade assembly comprising a body assembly having a pair of body end portions and at least one cross member extending therebetween. A first U-shaped housing is provided between the body end portions, the first U-shaped housing having a scalloped edge portion formed along at least one edge thereof; a resilient foam insert is provided, at least a portion of which is disposable within the first U-shaped housing, the insert being impregnated with a lubricating material. A second U-shaped housing is provided having a plurality of fluid dispensing apertures formed therein, the second U-shaped housing being supportable by the foam insert and translatable within a first U-shaped housing, beyond the scalloped edge portion, to discharge a lubricating fluid from the resilient foam insert through the fluid dispensing apertures. A plurality of blade supporting members disposed upon the second U-shaped housing, and a first blade is disposed between the body end portions adjacent the blade support members to cause compression of the foam insert in response to forces encountered during the shaving operation.

In the presently preferred embodiment, the resilient foam insert is pre-impregnated with soap to form a soapy fluid in response to translation of the second U-shaped housing in response to movement of the first blade. The fluid dispensing apertures are preferably disposed adjacent the blade to provide the lubricating fluid upon the surface to be shaved, adjacent the first blade.

A rotatable roller may also be provided between the body end portions, and formed as a plurality of separate roller elements, with a resilient member extending therein.

The assembly may also be provided with a lubricating strip disposed upon the body cross member upstream of the first blade.

A brush assembly may also be provided to extend between body end portions intermediate the roller assembly and the first blade. The brush assembly including a plurality of ribs for lifting whiskers before the whiskers encounter the first blade.

DETAILED DESCRIPTION OF THE PREFERRED EMBODIMENT

The detailed description set forth below in connection with the appended drawings is intended as a description of the presently preferred embodiments of the invention, and is not intended to represent the only form in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
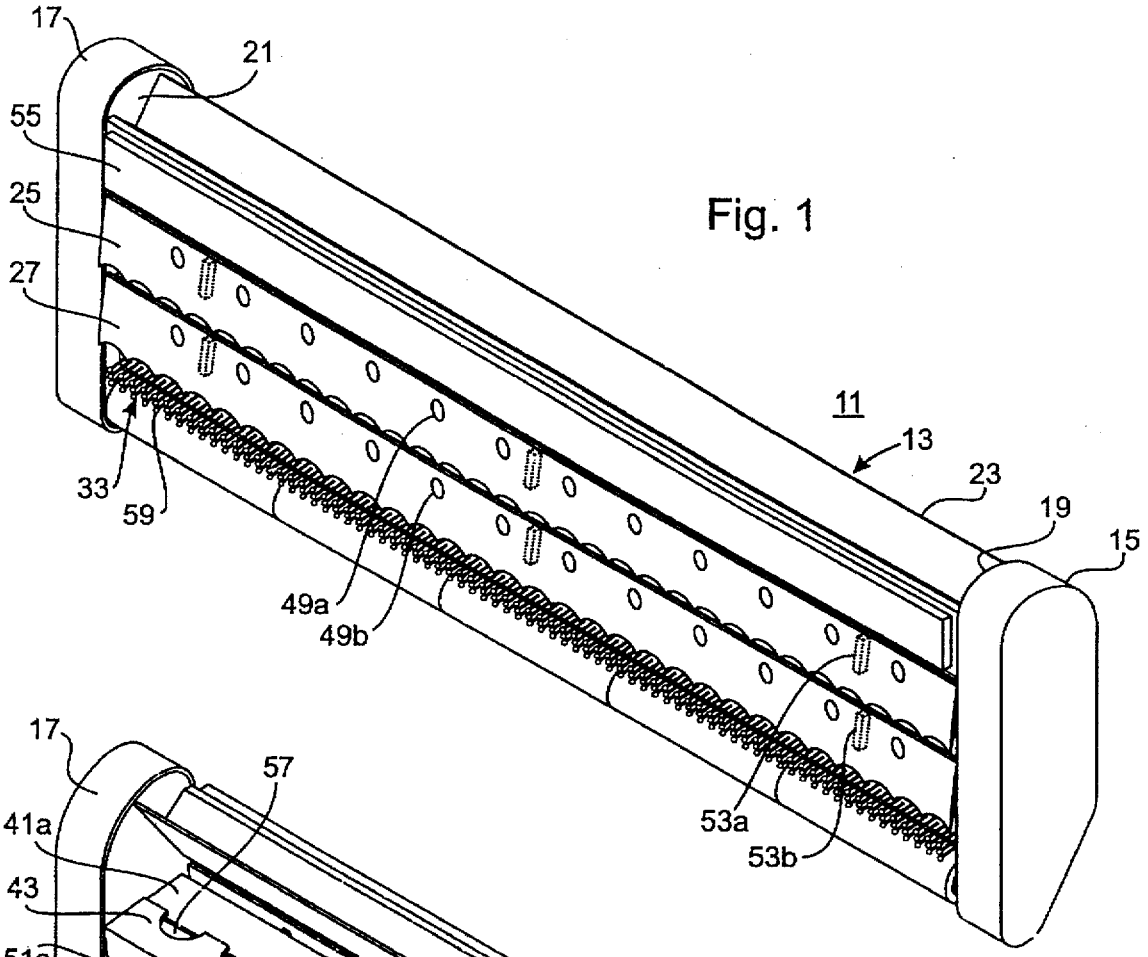
FIG. 1 is a front perspective view of a razor blade assembly in accordance with the present invention.

FIG. 1 of the drawings illustrates one embodiment of a razor blade assembly formed in accordance with the present invention. Shown therein, the razor blade assembly 11 includes a body assembly 13 bounded by end caps 15, 17. The body assembly 13 includes end portions 19, 21, shown more clearly at FIG. 3. Cross member 23 extends between the body end portions 19, 21 to provide rigidity to the body assembly 13. Cross member 23 may be formed to include lubricating strip receiving recess 53 for receiving a lubricating strip 55, such as a soap bar.

The blades 25 and 27 extend between the body end portions 17, 19. The blades 25, 27 are shown to have a scalloped or serrated edge portion 29, 31 on the leading edge thereof. However, it is anticipated that the blades 25, 27 may alternately be formed to have a straight leading edge, rather than a scalloped leading edge.

Also extending between the end portions 15, 17, are brush assembly 33 and may be formed to include a plurality of ribs 59, brush assembly 33, and roller assembly 35. The brush assembly 33 and roller assembly 35 function to lift whiskers up before they reach the blades 25, 27, to enhance the cutting action of the blades 25, 27. As shown at FIG. 3, the roller assembly 33 may be formed as a series of separate roller segments, such as 37*a*, 37*b*, disposed around a spring 39 or other wire member to allow the roller assembly 35 to deform in accordance with the contour of the surface being shaved.

Figure 2:
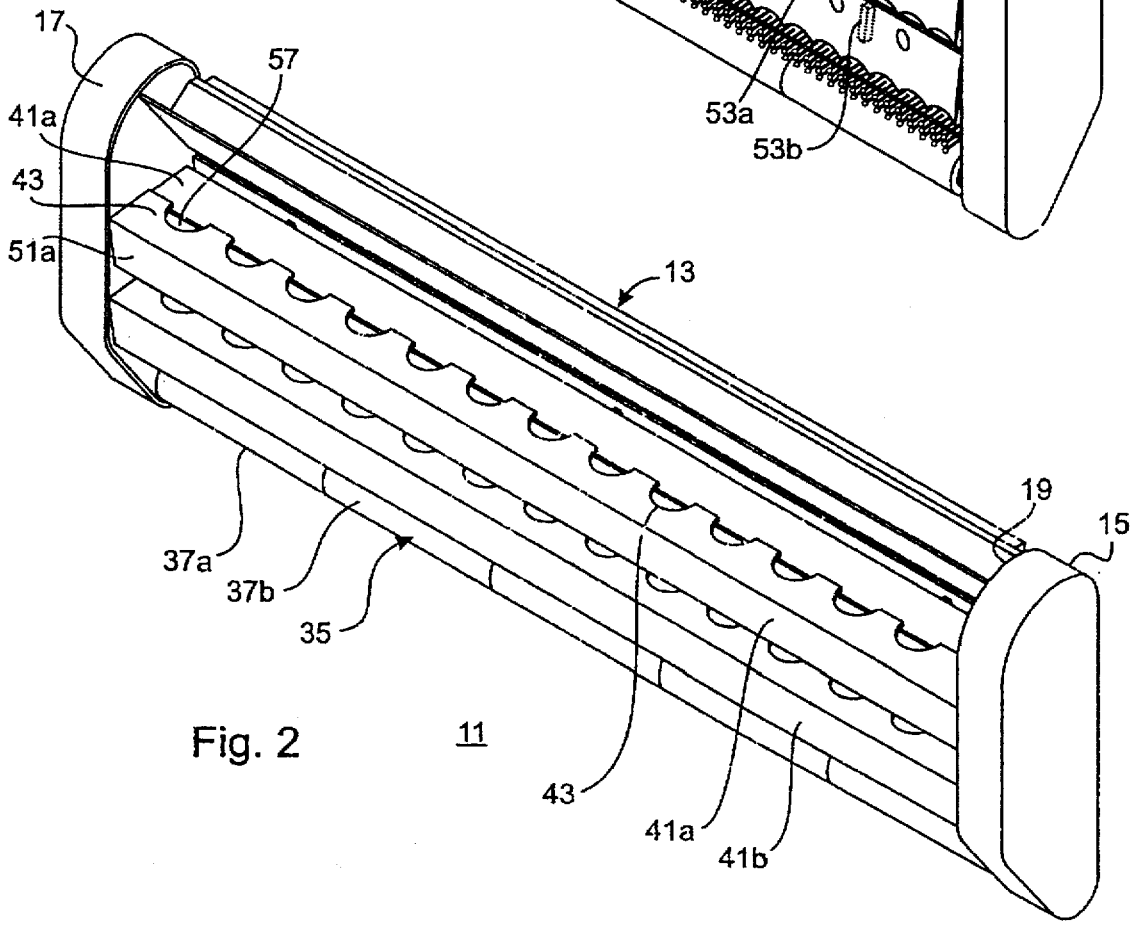
FIG. 2 is a rear perspective view of the razor blade assembly.
Figure 3:
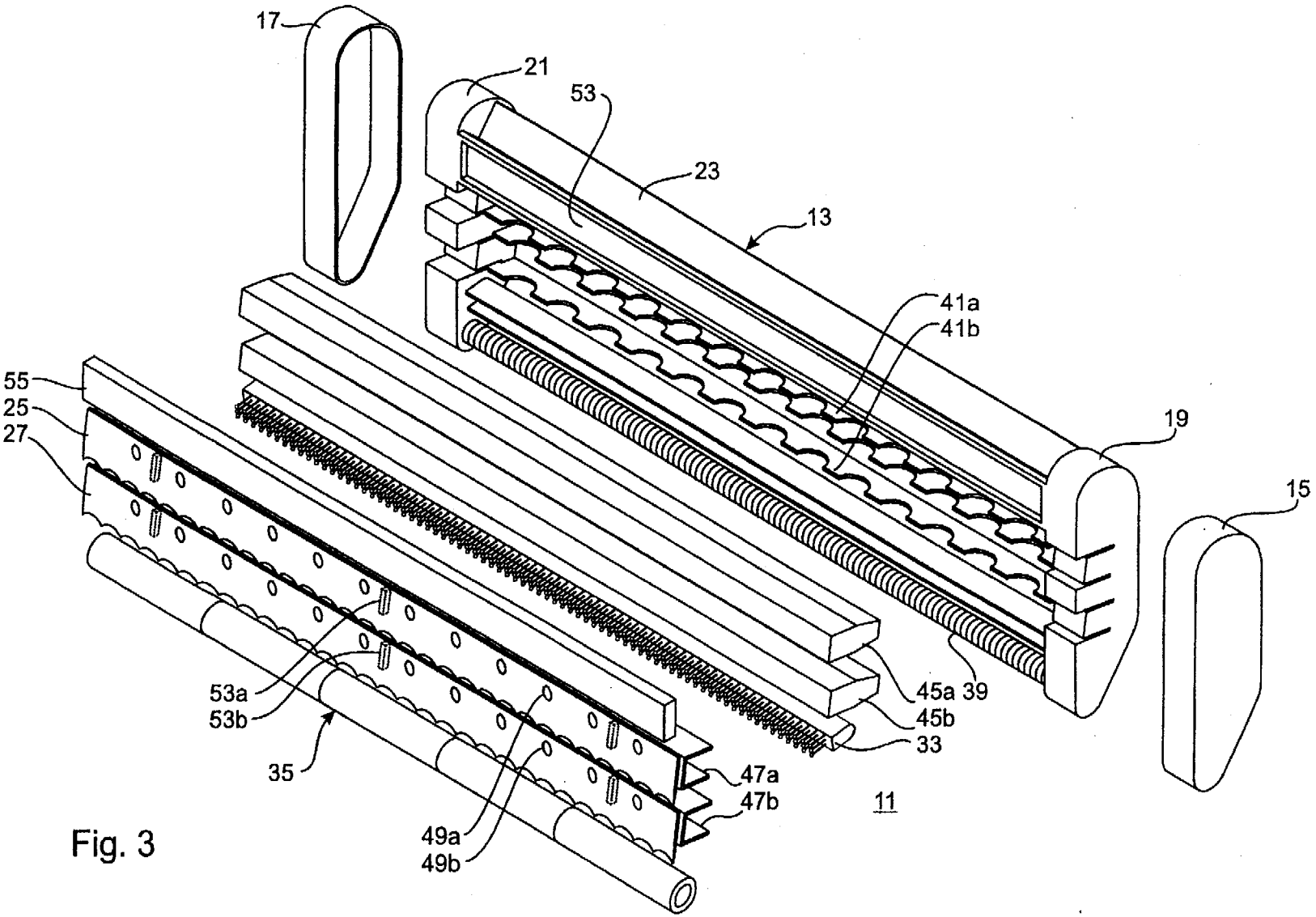
FIG. 3 is a front exploded view of the razor blade assembly.
Figure 4:
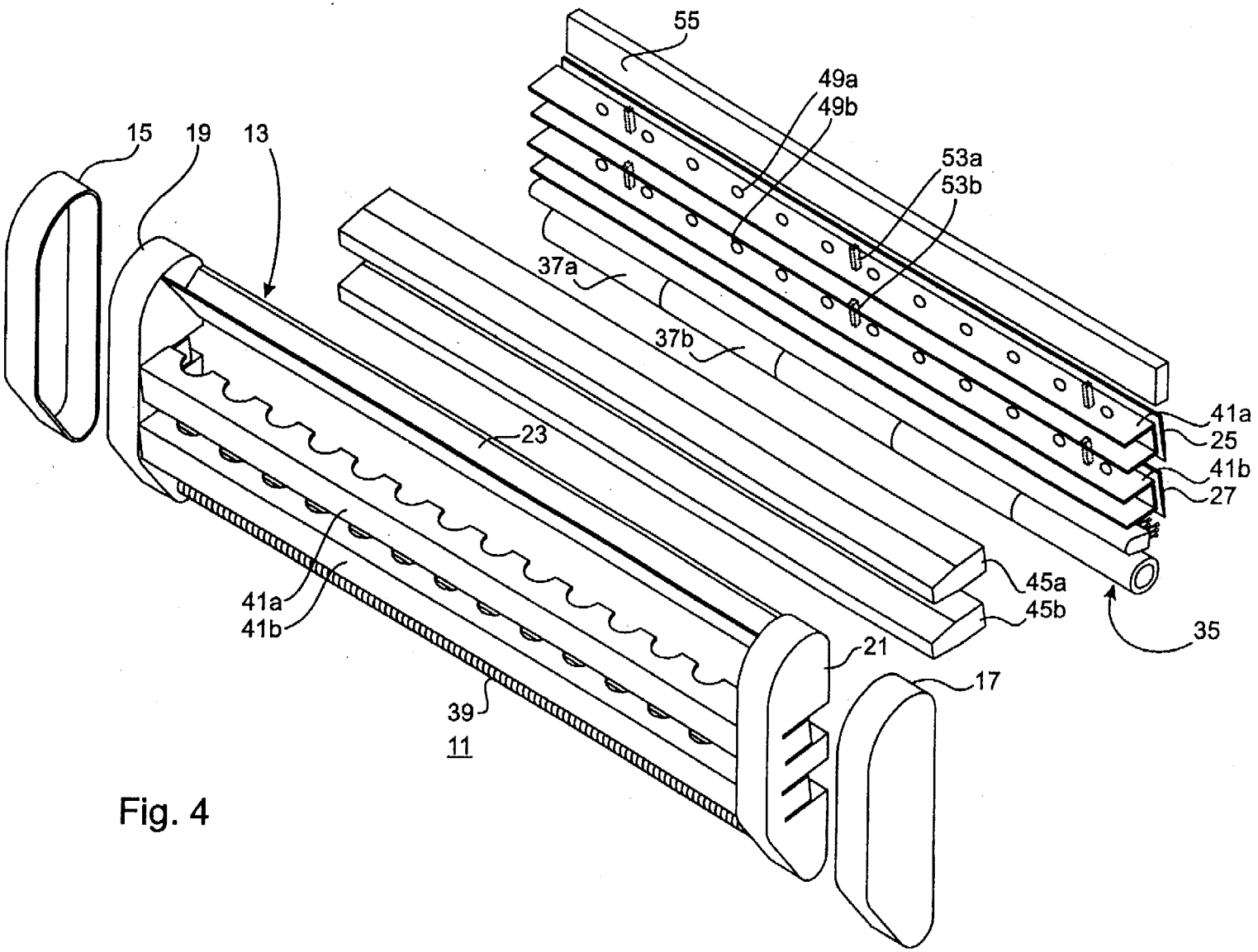
FIG. 4 is a rear exploded view of the razor blade assembly.
Figure 5:
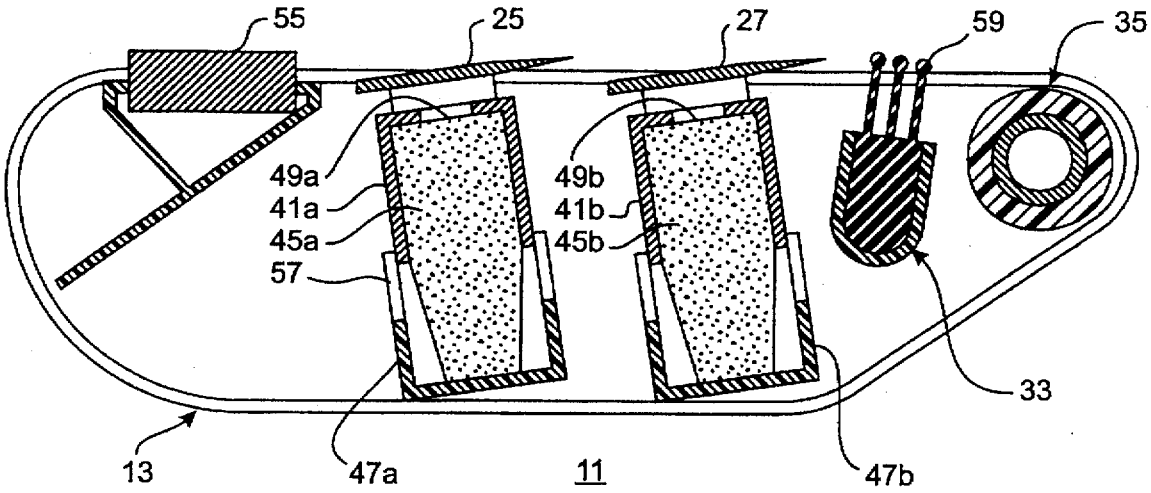
FIG. 5 is a side-sectional view of the razor blade assembly.

As also shown in FIGS. 2 and 3, the blades 25, 27 are supported a pair of reciprocating U-shaped housings, having a foam insert therebetween. The U-shaped housings are formed to have apertures and/or scalloped edge portions so as to permit water to enter and leave the foam insert in response to forces encountered during the shaving operation. As described in more detail below, the presently preferred embodiment is implemented to allow water to alternately be drawn into the foam insert and then discharged adjacent the leading edge of blades 25, 27, in response to forces encountered during the shaving operation. The foam insert is preferably impregnated with soap or some other type of lubricating material, such that a lubricating fluid is discharged onto the surface to be shaved immediately adjacent the leading edge of blades 25, 27, in response to the shaving operation. As such, the present invention mitigates or eliminates the need for the use of shaving cream and functions as a combination razor/lubrication applicator that is easily transportable and disposable.

The function of the present invention as an applicator of lubricating fluid can be described in conjunction with reference to FIGS. 1, 2, and 3. As shown therein, a pair of first U-shaped housings 41*a*, 41*b* are disposed intermediate the body end portions 19, 21. The U-shaped housings 41*a*, 41*b* are preferably formed to incorporate a plurality of recesses, which may be defined by scalloped edge portions, such as edge 43.

Foam inserts 45*a*, 45*b* are sized to seat within the U-shaped housings 41*a*, 41*b*. The foam inserts 45*a*, 45*b* may be formed of any resilient, absorbent material, preferably impregnated with a lubricated substance, such as soap. A pair of second U-shaped housings, 47*a*, 47*b* are formed to receive an opposite end portion of the foam inserts 45*a*, 45*b*. The housings 47*a*, 47*b* are further formed to incorporate a plurality of fluid dispensing apertures, such as apertures 49*a*, 49*b*. As such, the foam inserts 45*a*, 45*b* are resiliently encased intermediate first housings 41*a*, 41*b* and second housings 47*a*, 47*b*. Compression of the foam inserts 45*a*, 45*b* occurs when the second housings 47*a*, 47*b* translate toward first housings 41*a*, 41*b*. The size of the housings 41*a*, 41*b*, 47*a*, 47*b*, as well as the shape of the 51*b* translate beyond the scalloped edge portion 43 to substantially preclude the entrance or exit of water into the foam inserts via recess 57 defined by the scalloped edge portion 43. Further compression of the foam inserts 45*a*, 45*b* therefore causes water and lubricating fluid within the foam inserts 45*a*, 45*b* to be dispensed through dispensing apertures 49*a*, 49*b*. Movement of the U-shaped housings 51a, 51*b* in the opposite direction, i.e., causing expansion of the foam inserts 55*a*, 55*b*, uncovers the scalloped edge portion 43 to allow water to return into the foam inserts 45*a*, 45*b* via recess 57, defined by the scalloped edge portion 43.

As will be apparent to one of ordinary skill, the particular construction of the U-shaped housings 41*a*, 41*b*, 55*a*, 55*b*, and inserts 45*a*, 45*b* may be varied without departing from the broader aspects of the invention. In the presently preferred embodiment, the U-shaped housings 41*a*, 41*b* are formed to be somewhat narrower than U-shaped housings 51*a*, 51*b*. Similarly, the foam inserts 45*a*, 45*b* are preferably formed to have a smaller edge portion adjacent housings 41*a*, 41*b*, and a larger edge portion adjacent housing 51a, 51*b*. However, alternate configurations could be used which provide the same suction and pumping action to facilitate the discharge of lubricating fluid from the foam inserts.

Blades 25, 27 are supported upon housings 51a, 51*b* by a plurality of blade supporting members, such as members 53*a*, 53*b*. Forces acting on the blade in the course of shaving will therefore cause depression of the blades 25, 27, which causes translation of the U-shaped housings 51*a*, 51*b*, and compression of the foam inserts 45*a*, 45*b*, as described above. As a consequence, forces normally applied in the course of shaving result in compression of the foam inserts, and discharge of lubricating fluid in the area adjacent the blades 25, 27. As a consequence, the lubricating fluid is applied to the surface to be shaved, without the need for any further activity, other than the shaving itself.

As will also be apparent to one of ordinary skill in the art, the particular construction of the present invention may be modified that the foam inserts are placed in compression as the blades are listed, rather than depressed, in the course of the shaving process. In neither case, the translation of the blades is communicated through the foam insert such that lubricating fluid is dispensed to the surface being shaved solely in response to the shaving process itself.

These and other modifications and enhancements of the present invention can be implemented without departing from the broader aspects of the invention, as set forth below.

What is claimed is:

1. A razor blade assembly comprising:

a body assembly having a pair of body end portions and at least one body cross member extending therebetween;

a first U-shaped housing extending between the body end portions, the first U-shaped housing having a plurality of recesses formed thereon;

a resilient foam insert at least a portion of which being disposable within the first U-shaped housing, the insert being pre-impregnated with a lubricating material;

a second U-shaped housing having a plurality of fluid dispensing apertures formed therein, said second U-shaped housing being supportable by the foam insert and translatable within the first U-shaped housing beyond the recesses formed thereof;

a plurality of blade supporting members disposed upon the second U-shaped housing; and a first blade extending between the body end portions adjacent the blade support members.

2. The razor blade assembly as recited in claim 1 wherein the resilient foam insert is pre-impregnated with soap.

3. The razor blade assembly as recited in claim 1 wherein the second U-shaped housing translates in response wherein the second U-shaped housing translates in response to forces applied to the first blade during the shaving operation.

4. The razor blade assembly as recited in claim 3 wherein translation of the second U-shaped housing compresses the foam insert to discharge lubricating fluid through the fluid dispensing apertures.

5. The razor blade assembly as recited in claim 4 wherein the fluid dispensing apertures are disposed adjacent the first blade.

6. The razor blade assembly as recited in claim 1 further comprising a rotatable roller extending between the body end portions.

7. The razor blade assembly as recited in claim 6 further comprising a resilient member extending between the body end portions within the roller.

8. The razor blade assembly as recited in claim 7 wherein the roller is formed as a plurality of separate roller segments, each of the segments being independently rotatable.

9. The razor blade assembly as recited in claim 1 wherein the cross member is formed to have a lubricating strip receiving recess.

10. The razor blade assembly as recited in claim 9 further comprising a lubricating strip disposed within the lubricating strip receiving recess.

11. The razor blade assembly as recited in claim 1 further comprising a brush assembly extending between the body end portions adjacent the first blade, said brush assembly being formed to include a plurality of ribs for lifting whiskers before the whiskers encounter the first blade.

12. The razor blade assembly as recited in claim 1 further comprising a brush assembly extending between the body end portions disposed intermediate the first blade and the roller, said brush assembly being formed to include a plurality of ribs for lifting whiskers before the whiskers encounter the first blade.

* * * * *